US005921308A

United States Patent [19]

Martin

[11] Patent Number: 5,921,308

[45] **Date of Patent: *Jul. 13, 1999**

[54] BARRICADE APPARATUS AND METHOD FOR A JOINT IN A SECTIONAL DOOR

[75] Inventor: David O. Martin, Salt Lake City, Utah

[73] Assignee: Martin Door Manufacturing, Inc., Salt Lake City, Utah

[ * ] Notice: This patent is subject to a terminal disclaimer.

[21] Appl. No.: 08/858,525

[22] Filed: May 19, 1997

Related U.S. Application Data

[63] Continuation-in-part of application No. 08/401,562, Mar. 9, 1995, Pat. No. 5,630,459.

[51] Int. Cl.[6] ..... E06B 3/12

[52] U.S. Cl. ..... 160/236; 160/229.1; 49/383

[58] Field of Search ..... 160/229.1, 236, 160/201, 297; 49/383, 462

[56] References Cited

U.S. PATENT DOCUMENTS

| | | | |
|---|---|---|---|
| 2,882,564 | 4/1959 | Couse et al. | 160/229.1 |
| 3,319,697 | 5/1967 | Krohn | 160/229.1 |
| 3,608,613 | 9/1971 | Halliwell | 160/229.1 |
| 3,648,755 | 3/1972 | Theile | 160/229.1 |
| 4,995,441 | 2/1991 | Leist | 160/229.1 |
| 5,148,850 | 9/1992 | Urbanick | 160/229.1 |
| 5,630,459 | 5/1997 | Martin | 160/236 |
| 5,669,431 | 9/1997 | Druzynski et al. | 160/229.1 |

*Primary Examiner*—Daniel P. Stodola
*Assistant Examiner*—Curtis A. Cohen
*Attorney, Agent, or Firm*—J. Winslow Young

[57] ABSTRACT

A barricade apparatus for providing a barrier across the gap between door sections of a sectional door. The barricade is fabricated from a strip of resilient sheet material formed into a generally L-shaped configuration along its length. The horizontal foot portion of the L-shaped configuration is secured to the upper edge of a lower door section to thereby support the vertical leg portion across the gap that opens and closes as the adjacent door sections are moved across the curved portion of the support track of the sectional door.

12 Claims, 5 Drawing Sheets

BARRICADE APPARATUS AND METHOD FOR A JOINT IN A SECTIONAL DOOR

This application is a continuation-in-part of my application Ser. No. 08/401,562 filed Mar. 9, 1995 for SHIELD APPARATUS AND METHOD FOR SECTIONAL DOOR HINGE, now U.S. Pat. No. 5,630,459.

BACKGROUND

1. Field of the Invention

This invention relates to sectional doors and, more particularly to a novel barricade apparatus and method for precluding the inadvertent placement of fingers into the open joint that forms between door sections as the door sections sequentially traverse the curved track between the open and the closed positions.

2. The Prior Art

Sectional doors, also commonly referred to as overhead garage doors or, simply, overhead doors, are well known throughout the world. These particular doors are designated by these names by reason of their design/operation as well as their usage. In particular, sectional doors are designed to provide closure for a large opening such as the ingress/egress to an automotive garage. In order to accommodate closure of such a large opening, the sectional door is assembled from a plurality of horizontally oriented door sections having a length which spans the opening. The door sections are hingedly joined edge to edge to create the door, hence the name, sectional door. The ends of the door sections are supported and the movement thereof directed by tracks which are mounted on each end of the sectional door. The tracks are in a vertical orientation to support the sectional door in its vertical or closed position, and a horizontal orientation to support the sectional door in its open position. A curved section of track accommodates the transition between the vertical and horizontal orientations of the track. The hinged relationship between adjacent door sections allows the sectional door to traverse the curved track between the vertical, closed position to the overhead, open position, hence the alternative name, overhead door. The sectional door is moved between the vertical, closed orientation and the overhead, open configuration with the orientation thereof being controlled by the supportive tracks. Sectional doors are quite heavy so that various systems have been devised to compensate for this weight. Customarily, coil springs under tension provide the necessary weight compensatory force. An electric motor can be used to provide the motive force or the sectional door can be moved manually.

The planar external surface of the sectional door is achieved by forming the adjacent edges of the door sections with an interlocking tongue and groove relationship. The tongue portion is located on the upper edge of the lower door section while the groove portion is located on the lower edge of the upper door section. This particular orientation of the tongue and groove relationship is used throughout the sectional door industry in order not only to provide a more uniform or planar appearance to the closed sectional door but also to reduce the amount of water that would otherwise collect in the groove portion if the tongue and groove relationship were reversed.

The hinges for the adjacent sections of the sectional door are mounted on the interior face of the sectional door. This hinge placement creates a relatively large gap between adjacent door sections as they sequentially traverse the curved track between the open/closed positions.

Specifically, it is during the transition from the upper, horizontal, open position to the lower, vertical, closed position that this gap becomes significant in that it gapes open significantly as the lower door section turns to the vertical orientation while the next succeeding door section continues its transition from the horizontal to the vertical orientation. This gap results from the fact that the sectional door is relatively thick and the hinge line between adjacent door sections is mounted on the inner face of the sectional door so that the change in orientation for each planar, door section from the horizontal to the vertical will create a gap between it and the following door section. As can be seen, this gap is relatively large. However, just as importantly, this gap rapidly closes as the two door sections assume the vertical orientation. The relatively wide spacing of this gap coupled with its relatively rapid rate of closure has resulted in serious injury to persons who either deliberately or inadvertently place their fingers in the rapidly closing gap. Deliberate placement of fingers occurs when the person attempts to hasten the closure of the door while inadvertent placement occurs when the person simply is not paying attention. In both instances the results can be quite serious including amputation of the affected fingertips.

Regrettably, thousands of these tragedies have occurred with prior art sectional doors and, until the present inventions, there were no systems that effectively barricaded the gaps in a sectional door as it moved downwardly to the closed position. One company attempted to solve this problem by providing a modified edge system for its sectional doors. This was done by changing the abutting edges of the door sections from a transverse tongue and groove relationship to a slanted edge relationship. The slanted edge removes the conventional ninety degree corner and replaces it with a slanted surface so that a person attempting to grasp the upper edge of the downwardly moving door section will grasp only a slanted surface. Additionally, the bottom edge of the following door section is designed to slidingly push away any fingers that may have been placed on the slanted edge. However, such a sectional door has a distinct disadvantage in that when it is oriented vertically in the closed position each door section rests upon the slanted surface of the next section below. The heavy weight of the sectional door and the slanted surface between adjacent door sections forces the door sections out of their planar alignment rendering a somewhat shiplap-type appearance to the sectional door.

In view of the foregoing it would be a significant advancement in the art to provide a barricade apparatus and method for barricading the gap between door sections particularly during movement of the sectional door to its closed position. It would be an even further advancement in the art to provide a barricade apparatus having sufficient resiliency to preclude injury to fingers inserted behind the barricade. It would also be an advancement in the art to provide a barricade apparatus that could be used to retrofit existing sectional doors. Such a novel barricade apparatus and method for barricading the gap between door sections of a sectional door are disclosed and claimed herein.

BRIEF SUMMARY AND OBJECTS OF THE INVENTION

This invention involves a barricade apparatus and method for barricading the gap that forms between two adjacent, hinged door sections of a sectional door as the sectional door is moved from its open position to its closed position. The barricade is configured as an elongated strip of resilient sheet material having a length corresponding to the length of the door section. The strip is formed longitudinally with a generally L-shaped cross section. The foot portion of the L-shape is configured to be mounted to the upper edge of the lower door section while the leg portion of the L-shape extends upwardly to form a barrier across the gap between the two door sections. This barrier prevents the inadvertent or even deliberate insertion of one or more fingers into the gap. The barricade apparatus is shipped by being releasably mounted to the bottom edge of the upper door section with the leg portion being releasably secured against the surface of the door section. Upon assembly of the door section into a sectional door, the foot portion of the barricade is secured to the abutting, upper edge of the lower door section and the leg portion is released from the upper door section.

It is, therefore, a primary object of this invention to provide improvements in barricades for the gap between adjacent sections of a sectional door.

Another object of this invention is to provide improvements in the method for creating a barrier across the gap between adjacent door sections of a sectional door.

Another object of this invention is to provide a barricade apparatus for the gap between door sections of a sectional door.

Another object of this invention is to provide a barricade configured as a strip of resilient sheet material having a length corresponding to the width of the sectional door and formed with an L-shaped cross section with the foot portion of the L-shape residing between the two adjacent door sections with the leg portion of the L-shape forming a barrier across the gap between the two sections.

Another object of this invention is to provide a barricade apparatus that can be used to retrofit existing sectional doors.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
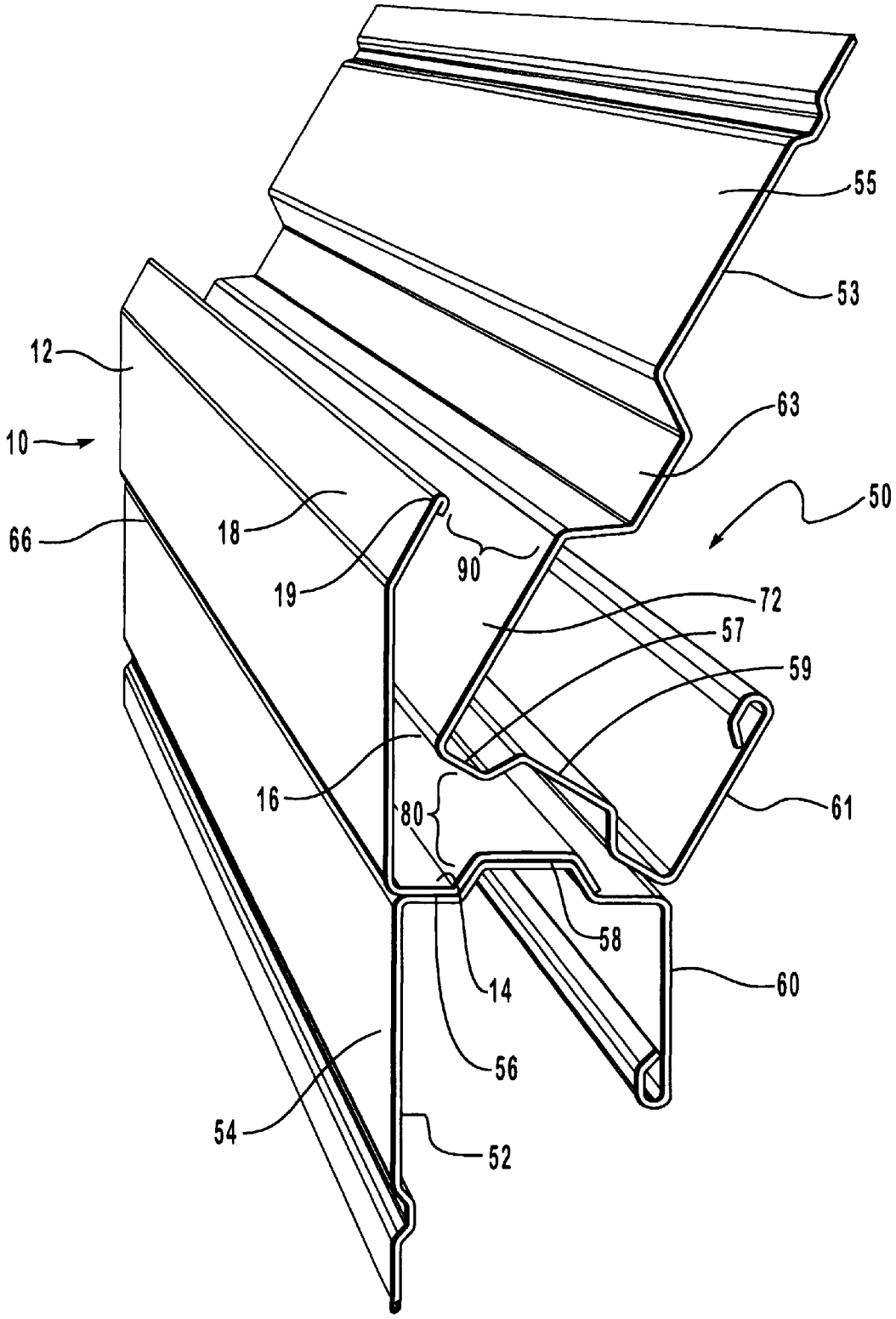
FIG. 1 is a perspective view of adjacent door sections of a sectional door during its transition between the open and closed positions showing my novel barricade across the gap formed between the two door sections.

The invention is best understood by reference to the drawing wherein like parts are designated by like numerals throughout in conjunction with the following description.

General Discussion of the Invention

The novel barricade apparatus and method of this invention provides a sectional door with a safe, aesthetically pleasing barrier system for preventing fingers from being inserted into the hinge opening between the sections of the sectional door as it is being moved to the closed position. The barricade is fabricated from a resilient sheet material and configured with a modified L-shaped cross section having a vertical leg and a horizontal foot. The foot portion of the L-shaped barricade is secured to the top edge of the lower door section so as to support the vertical leg of the L-shaped barricade as a barrier across the gap that opens and closes as the adjacent sections of the sectional door move downwardly. The exterior face of the leg portion of the barricade is configured to blend with the color and surface texture of the sectional door to provide an aesthetically pleasing appearance. The length of the vertical leg is coordinated with the pattern of the corresponding edge of the underlying portion of the upper door section so as to have the upper edge of the vertical leg blend into the pattern of the upper door section.

The barricade is mounted to the sectional door by securing the foot portion to the upper edge of the lower door section in such a manner as to cause the leg portion to extend upwardly to form a barrier across the gap that is created as the door sections are hingedly pivoted relative to each other. Importantly, the leg portion has sufficient resiliency to allow it to flex outwardly in the event a finger is inserted between it and the upper door section. Additionally, the vertical length of the leg portion is sufficient to preclude even the most determined individual from placing his/her fingers into the gap between the door sections.

Detailed Description

Figure 2:
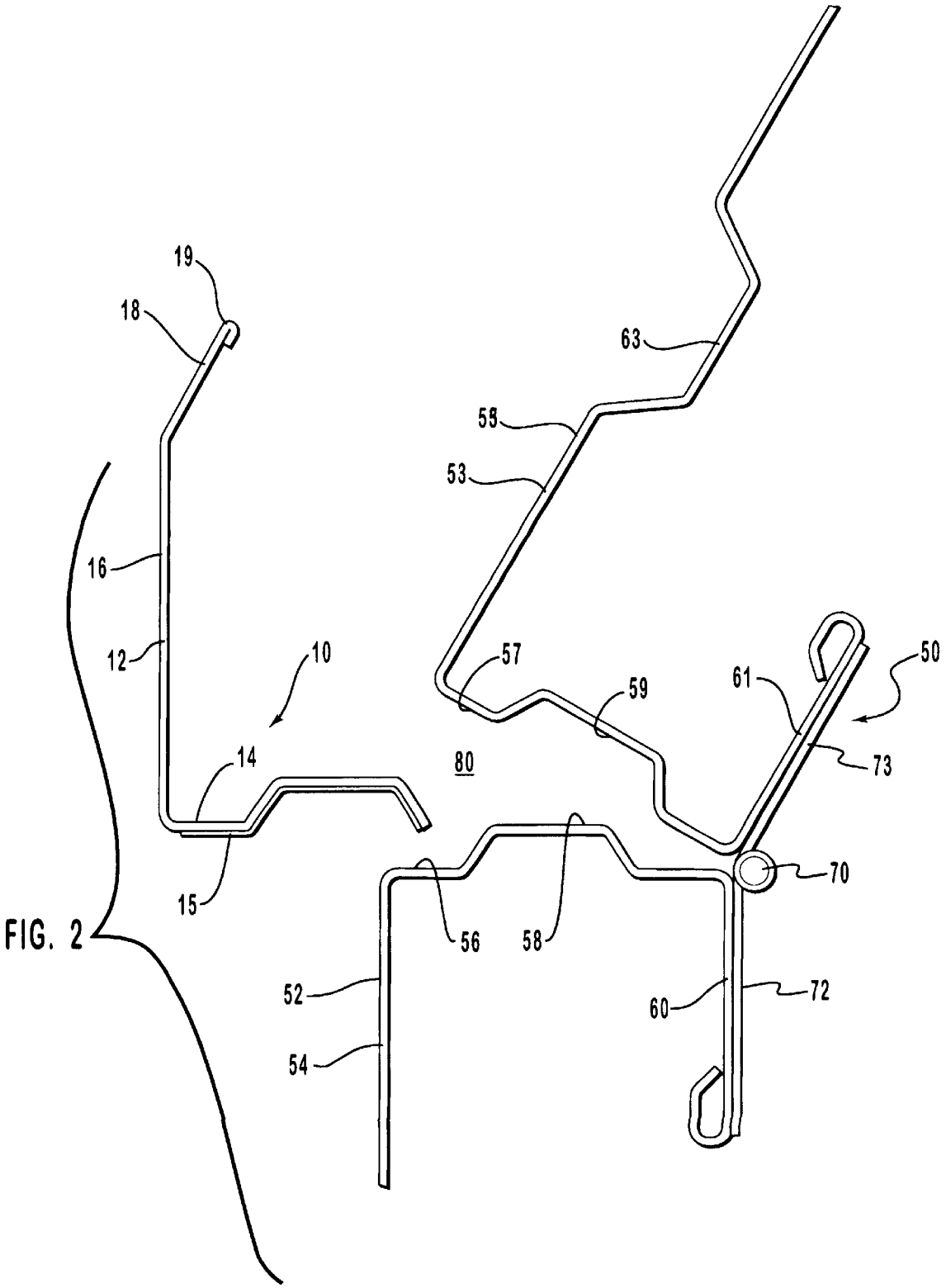
FIG. 2 is an exploded, enlarged, end view of a preferred embodiment of the novel barricade apparatus of this invention prior to installation into the joint between adjacent door sections.
Figure 3:
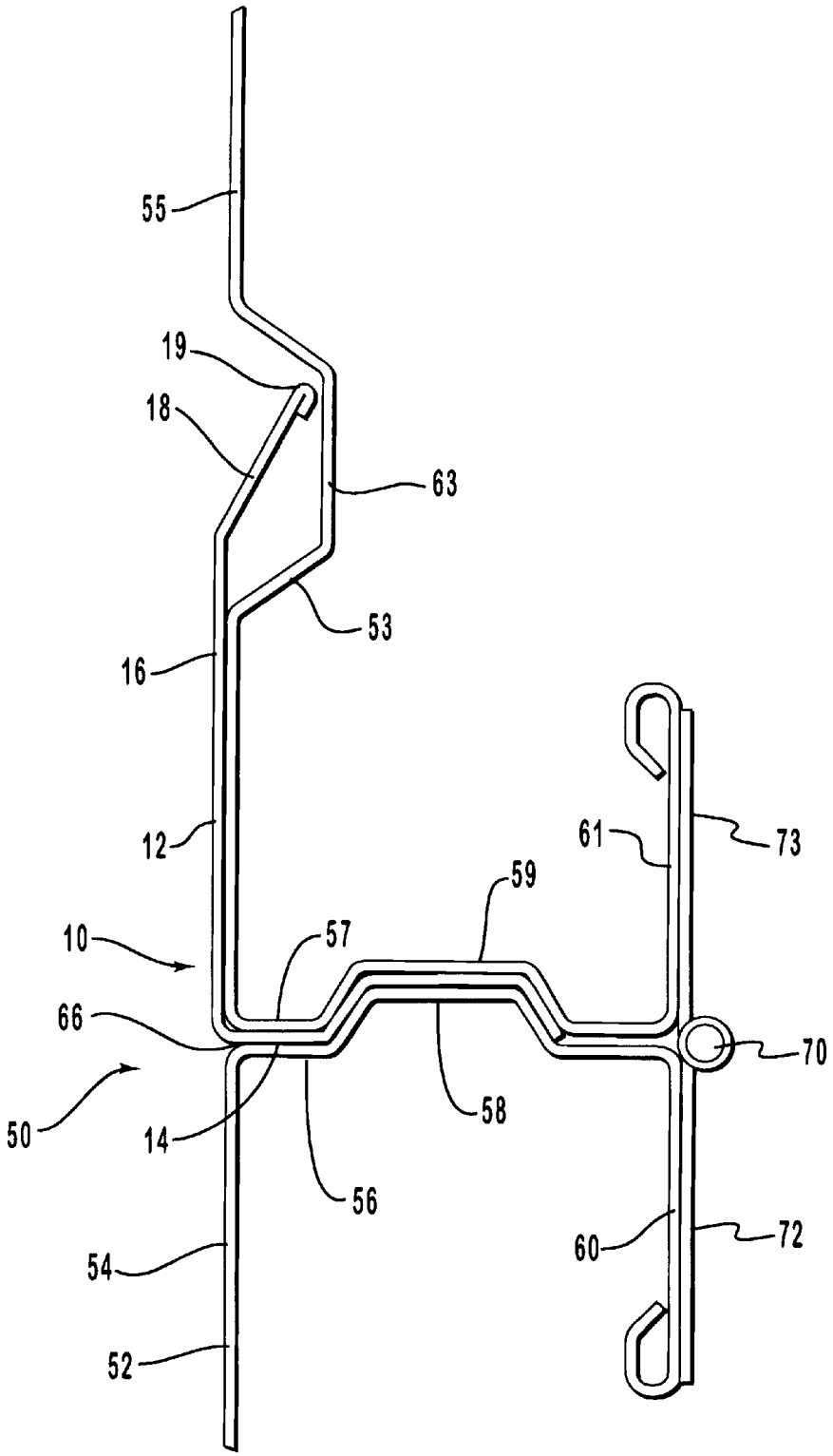
FIG. 3 is the end view of FIG. 2 showing the barricade installed into the joint between adjacent door sections.

Referring now to FIGS. 1–3, the novel barricade apparatus of this invention is shown generally at 10 in the environment of a conventional sectional door 50. Barricade 10 includes a strip of resilient sheet material 12 formed into a generally L-shaped cross section having a horizontally oriented foot portion 14 and a vertically oriented leg portion 16. The upper edge of leg portion 16 is bent inwardly into a closure 18 having a single hem 19 formed along the interior edge thereof.

Sectional door 50 includes a lower door section 52 and an upper door section 53 hingedly joined together by a hinge 70 (FIGS. 2 and 3) along their abutting corners on the inside face of sectional door 50. Lower door section 52 includes a facia 54 for presenting a pleasing external appearance. An upper edge 56 includes a tongue 58 formed therein. A return 60 depends downwardly from upper edge 56 and serves as a mounting surface for a leaf 72 of hinge 70. Upper door section 53 also includes a facia 55 which terminates downwardly in a bottom edge 57 having a groove 59 formed therein. A return 61 extends upwardly from bottom edge 57 and provides the mounting surface for leaf 73 of hinge 70. Tongue 58 is received in groove 59 in a conventional tongue-and-groove relationship to thereby impart a limited degree of lateral stability to sectional door 50 as is common in the industry. Facia 55 includes a transverse channel 63 along the face thereof. Channel 63 receives closure 18 therein when upper door section 53 and lower door section 52 are aligned in a planar relationship as will be discussed more fully hereinafter.

Foot portion 14 is configured with a profile that corresponds to the mating profile of tongue 58 and groove 59 so as to readily adapt foot portion to being mounted to upper edge 56 in a snug-fit relationship. Importantly, foot portion 14 is sufficiently thin so that it is readily received in the confines between upper edge 56 and lower edge 57 without interfering with the operation of sectional door 50. Accordingly, my novel barricade 10 can be readily adapted to existing sectional doors 50 as a retrofit. Importantly, foot portion 14 is adhesively mounted to upper edge 56 by a thin layer of adhesive 15 (FIG. 2) to thereby permanently secure barricade 10 to upper edge 56 so that barricade 10 effectively becomes an extension of lower door section 52. As such, leg portion 16 extends upwardly to present a barrier across the gap 80 between bottom edge 56 and upper edge 57 when lower door section 52 and upper door section 53 are pivotally rotated about hinge 70.

Figure 4:
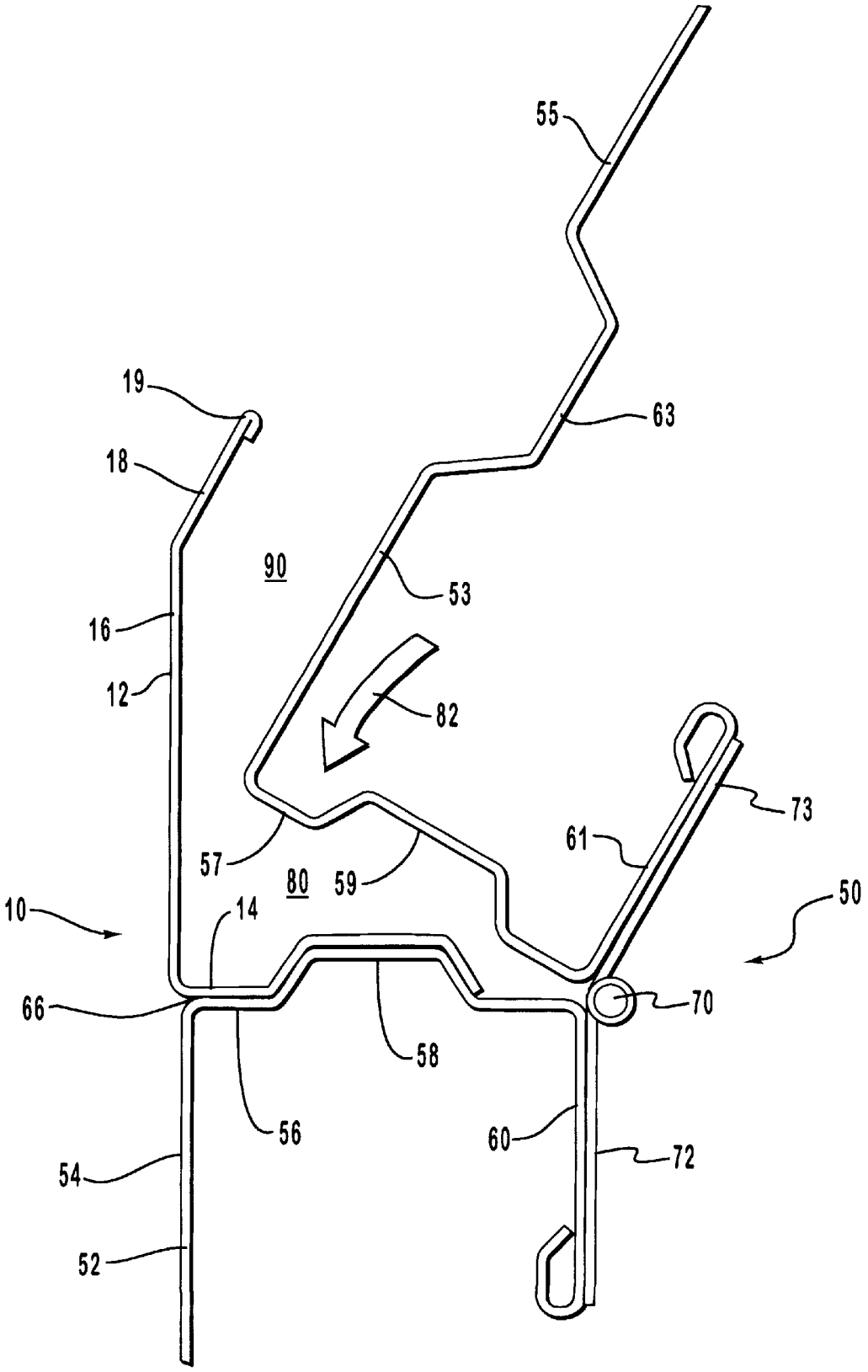
FIG. 4 is an end view of the barricade apparatus of FIG. 3 showing how it forms a barrier across the gap between adjacent door sections as the upper door section closes against the lower door section.
Figure 5:
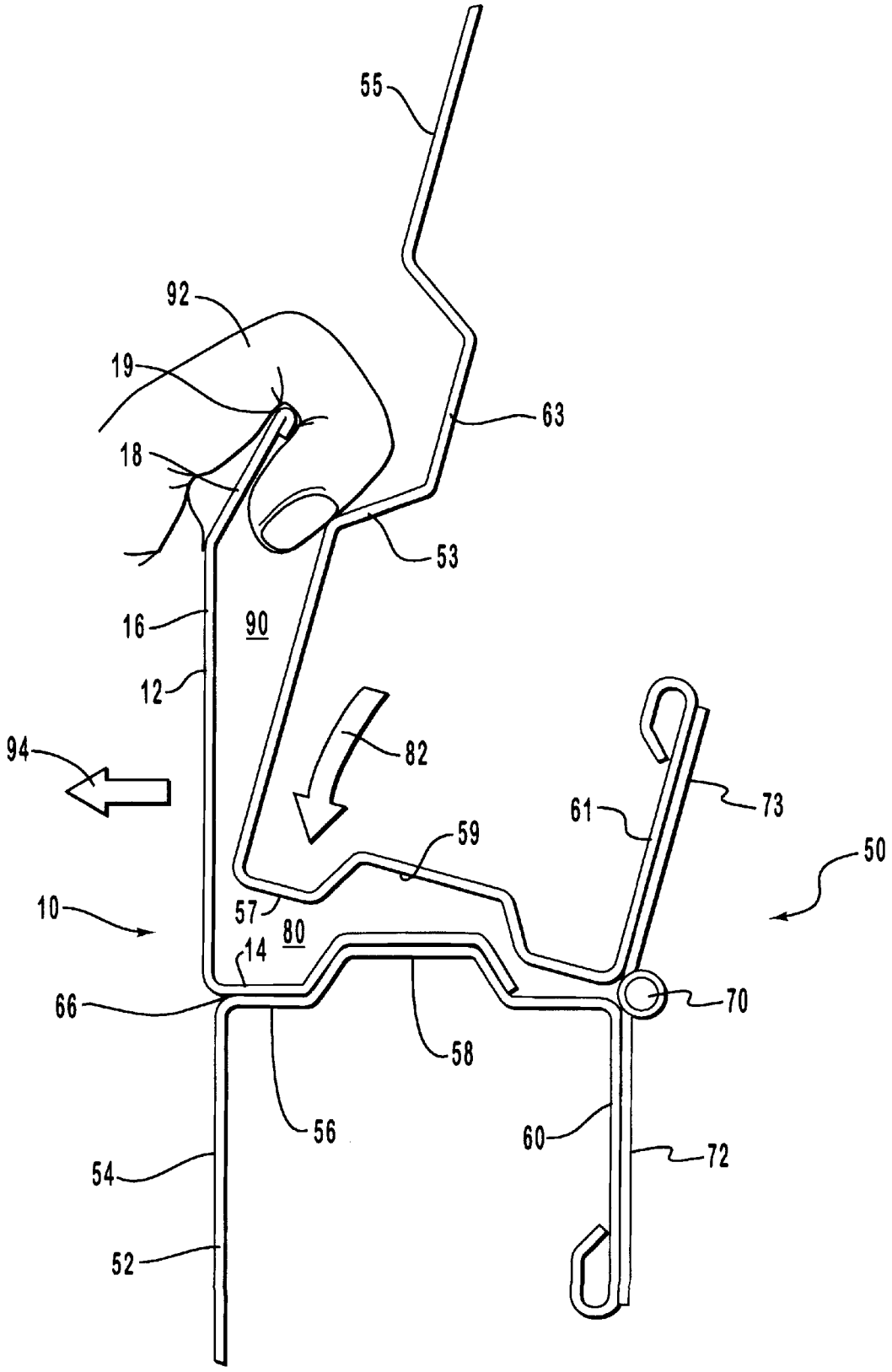
FIG. 5 is the end view of the barricade apparatus of FIG. 4 shown in the environment of a finger to illustrate how my novel barricade prevents the finger from being inserted into the gap between adjacent door sections.

Referring now to FIGS. 4 and 5, the function of barricade 10 is readily shown. In particular, with barricade 10 mounted to top edge 56 it is now in a blocking position across gap 80 that inherently forms when the plane of upper door section 53 is angularly offset from the plane of lower door section 52. This shielding or barrier function by barricade 10 occurs since vertical leg 16 remains coplanar with facia 54 of lower door section 52 and thus in a barrier position across gap 80. Further, the inwardly angled orientation of closure 18 further shields gap 80 against either the inadvertent or deliberate intrusion of fingers 92 into gap 80. In the event a person does grasp closure 18 and places his/her fingers 92 into the rapidly closing space represented by secondary gap 90 between closure 18 and facia 55 of upper door section 53, the resiliency of sheet material 12 as shown by flex arrow 94 inherently prevents injury to fingers 92. Specifically, the closure of gap 80 is illustrated by closure arrow 82 which shows the downward movement of bottom edge 57 into engagement with horizontal foot 14 and upper edge 56 of lower door section 56. As can be readily observed from FIG. 5, the absence of barricade 10 would expose gap 80 to the intrusion of fingers 92. Given the weight of sectional door 50 and the rapidity with which gap 80 is closed during movement as shown by closure arrow 82, it is easily understandable why literally thousands of fingers have been crushed by the conventional sectional door 50 in the absence of my novel barricade 10.

Advantageously, my novel barricade 10 very effectively and efficiently forms a permanent barrier across gap 80. Clearly, of course, a secondary gap 90 will be created as upper door section 53 is pivotally rotated out of its coplanar orientation with lower door section 52. However, as shown in FIG. 5, even if fingers 92 are inserted into secondary gap 90, barricade 10 forms a sufficient barrier to prevent fingers 92 from extending downwardly into gap 80. In particular, the length of vertical leg 16 along with the vertical length of closure 18 are both sufficient to prevent fingers 92 from entering gap 80. The resiliency of resilient sheet material 12 is sufficient to allow closure 18 and vertical leg 16 to flex outwardly as shown by flex arrow 94 in event fingers 92 are placed into secondary gap 90 during the aforesaid closure as represented by closure arrow 82. The resiliency of resilient sheet material 12 is selectively predetermined so as to provide flexure which is sufficient to preclude injury to fingers 92. Further, the contour of hem 19 is sufficient to preclude fingers 92 from being cut by hem 19.

When in the closed position and with the plane of upper door section 53 residing coplanar with the plane of lower door section 52, closure 18 nests in an underlying channel 63 formed across the face of upper door section 53. This nesting relationship imparts a pleasing visual appearance to sectional door 50 while at the same time reduces substantially the volume of any water that might seep behind barricade 10. The visual appearance of sectional door 50 is also enhanced by the presence of barricade 10 since the only visible indication of the joint between upper door section 55 and lower door section 52 is a joint line 66 where vertical leg 16 abuts the corresponding corner of top edge 56. Since joint line 66 is permanent, it is not affected by any minor changes in the overall alignment of upper door section 53 with lower door section 52 by reason of hinge wear, etc.

The Method

The novel method of my invention includes obtaining a strip of resilient sheet material 12 having a length corresponding to the overall width of sectional door 50 and forming sheet material 12 into barricade 10. Specifically, barricade 10 is created by being formed along its length into a generally L-shaped configuration thereby producing vertical leg 16 along with closure 18 and horizontal foot 14. Single hem 19 is formed along the edge of closure 18 to eliminate any sharp edges that would otherwise be exposed. Horizontal foot 14 is shaped to match the tongue and groove relationship between lower door section 52 and upper door section 53. With barricade 10 formed into the foregoing L-shaped configuration, it is ready for attachment to top edge 56 to provide its shielding action to sectional door 50.

Barricade 10 is secured to top edge 56 by adhesive 15 so as to extend vertical leg 16 coplanar with facia 54 with only joint line 66 to reveal the joinder between barricade 10 and top edge 56. At no time is gap 80 exposed or otherwise presented in such a way that fingers 92 can be inserted therein. Further, the combined length of vertical leg 16 and closure 18 is sufficient to prevent even the longest of fingers 92 being inserted therein into gap 80. At best, fingers 92 can only enter secondary gap 90 with the result that flex 94 readily accommodates for the presence of fingers 92 without any harm being done to fingers 92.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In combination, a barricade and a sectional door, said barricade shielding the gap between a lower edge of an upper door section of said sectional door and the upper edge of a lower door section of said sectional door, said lower edge and said upper edge having a first tongue and groove profile, said barricade comprising:

a strip of sheet material having a length generally corresponding to the width of said sectional door, said strip of sheet material being formed into an L-shaped configuration along said length, said L-shaped configuration providing said strip of sheet material with a vertical leg portion and a horizontal foot portion;

a second tongue and groove profile in said foot portion, said second tongue and groove profile being configured to match said first tongue and groove profile; and mounting means for mounting said foot portion to said upper edge of the lower door section, said foot portion thereby supporting said vertical leg portion between said upper edge of said lower door section and said lower edge of said upper door section.

2. The barricade defined in claim 1 wherein said strip of sheet material includes a predetermined degree of resiliency in said strip of sheet material to preclude injury to fingers inserted between said vertical leg portion and the underlying upper door section.

3. The barricade defined in claim 1 wherein said vertical leg portion includes a preselected vertical distance to preclude fingers from being inserted behind said vertical leg portion into the gap between the upper edge of the lower door section and the lower edge of the upper door section.

4. The barricade defined in claim 3 wherein said vertical leg portion includes a closure formed in said vertical leg portion, said closure being formed as a planar strip along said vertical leg portion and angularly offset toward the upper door section, the upper door section including a channel for receiving said closure.

5. The barricade defined in claim 1 wherein said vertical leg portion terminates upwardly in a hem to eliminate any sharp edge along said vertical leg portion.

6. The barricade defined in claim 1 wherein said mounting means comprises an adhesive means for adhesively securing said horizontal foot portion to the upper edge of the lower door section.

7. The barricade defined in claim 1 wherein said sheet material comprises a predetermined degree of resiliency to preclude injury to fingers placed between said vertical leg and the sectional door.

8. The barricade defined in claim 1 wherein said vertical leg includes a predetermined height selectively predetermined to preclude fingers from being inserted between upper door section and the lower door section.

9. The barricade defined in claim 8 wherein said predetermined height includes a closure formed as a planar element on said vertical leg, said planar element being angularly offset from said vertical leg toward the sectional door.

10. The barricade defined in claim 9 wherein the sectional door includes a channel for receiving said closure.

11. The barricade defined in claim 9 wherein said closure terminates in a hem to preclude said closure from cutting fingers placed behind said closure.

12. The barricade defined in claim 1 wherein said horizontal foot is selectively formed with a tongue and groove profile.

* * * * *